United States Patent [19]

Davidson

[11] Patent Number: 5,058,326

[45] Date of Patent: Oct. 22, 1991

[54] TILTING SYSTEM FOR CENTRIFUGAL FINISHING MACHINE

[75] Inventor: Richard S. Davidson, Sturgis, Mich.

[73] Assignee: The Grav-I-Flo Corporation, Sturgis, Mich.

[21] Appl. No.: 570,321

[22] Filed: Aug. 21, 1990

[51] Int. Cl.[5] ..... B24B 31/023; B24B 31/00; B24B 49/08

[52] U.S. Cl. ..... 51/163.1; 51/164.1; 51/165.9

[58] Field of Search ..... 51/163.1, 163.2, 164.1, 51/215 UE, 422, 313, 165.9

[56] References Cited

U.S. PATENT DOCUMENTS

| | | | |
|---|---|---|---|
| 782,700 | 2/1905 | Rusby | 51/164.1 X |
| 3,139,708 | 7/1964 | Oetiker | 51/164.1 |
| 3,173,664 | 3/1965 | Isaacson | 51/163.1 X |
| 4,380,137 | 9/1983 | Balz | 51/163.1 |
| 4,566,426 | 1/1986 | Schleich | 51/165.9 X |

*Primary Examiner*—Frederick R. Schmidt
*Assistant Examiner*—Bruce P. Watson
*Attorney, Agent, or Firm*—Barnes, Kisselle, Raisch, Choate, Whittemore & Hulbert

[57] ABSTRACT

A tilting system for centrifugal finishing machines which include a finishing chamber or tub in which parts or work pieces are treated and which is pivoted about a horizontal axis for tilting to remove the parts comprising a hydro-mechanical system which permits free movement from an upright to a tilted position and retards movement from a tilted position to an upright position. The hydro-mechanical system preferably includes a hydraulic linear actuator which has a piston rod with pistons at each end and is connected by a rack and pinion arrangement to the tub. A line extends from one end of the actuator to the other and a one way flow control valve is provided in the line. The tilting motion may be applied manually or by power.

5 Claims, 3 Drawing Sheets

TILTING SYSTEM FOR CENTRIFUGAL FINISHING MACHINE

This invention relates to centrifugal finishing machines and particularly to tilting of such centrifugal finishing machines.

BACKGROUND AND SUMMARY OF THE INVENTION

In the operation of a centrifugal finishing machine, the contents of the finishing chamber or tub must be removed at the conclusion of the process cycle. A pivoted horizontal axis is generally provided so that the machine tub can be tilted similar to a cement mixer and the contents flow out onto some separation device, conveyor or bin. A manual lever may be used to pull the tub forward for unloading. Presently, a tab, either welded or bolted to the tub, is utilized as a "stop", which holds the machine tub in an upright position. After the contents of the tub are removed, the operator must physically ease the tub back to the "stop" while holding the extra weight of the motor and gearbox on the tub, since the media and parts balance the load. If the operator should slip and accidentally release the handle, the tub will rapidly tilt back to the "stop", possibly causing severe injury to the operator and fracturing the "stop".

In accordance with the invention, a tilting system for centrifugal finishing machines which include a finishing chamber or tub in which parts or work pieces are treated and which is pivoted about a horizontal axis for tilting to remove the parts comprises a hydro-mechanical system which permits free movement from an upright to tilted position and retards movement from a tilted position to a upright position. The hydro-mechanical system preferably includes a hydraulic linear actuator which has a piston rod with pistons at each end and is connected by a rack and pinion arrangement to the tub. A line extends from one end of the actuator to the other and a one way flow control valve is provided in the line. The tilting motion may be applied manually or by power.

DESCRIPTION

In accordance with the invention, a hydro-mechanical system is associated with the tub and functions to restrict and control movement to the tilting position by permitting free flow in the system and to permit free movement from an upright position to a tilted position and restricts flow from a tilted position to an upright position.

Figure 1:
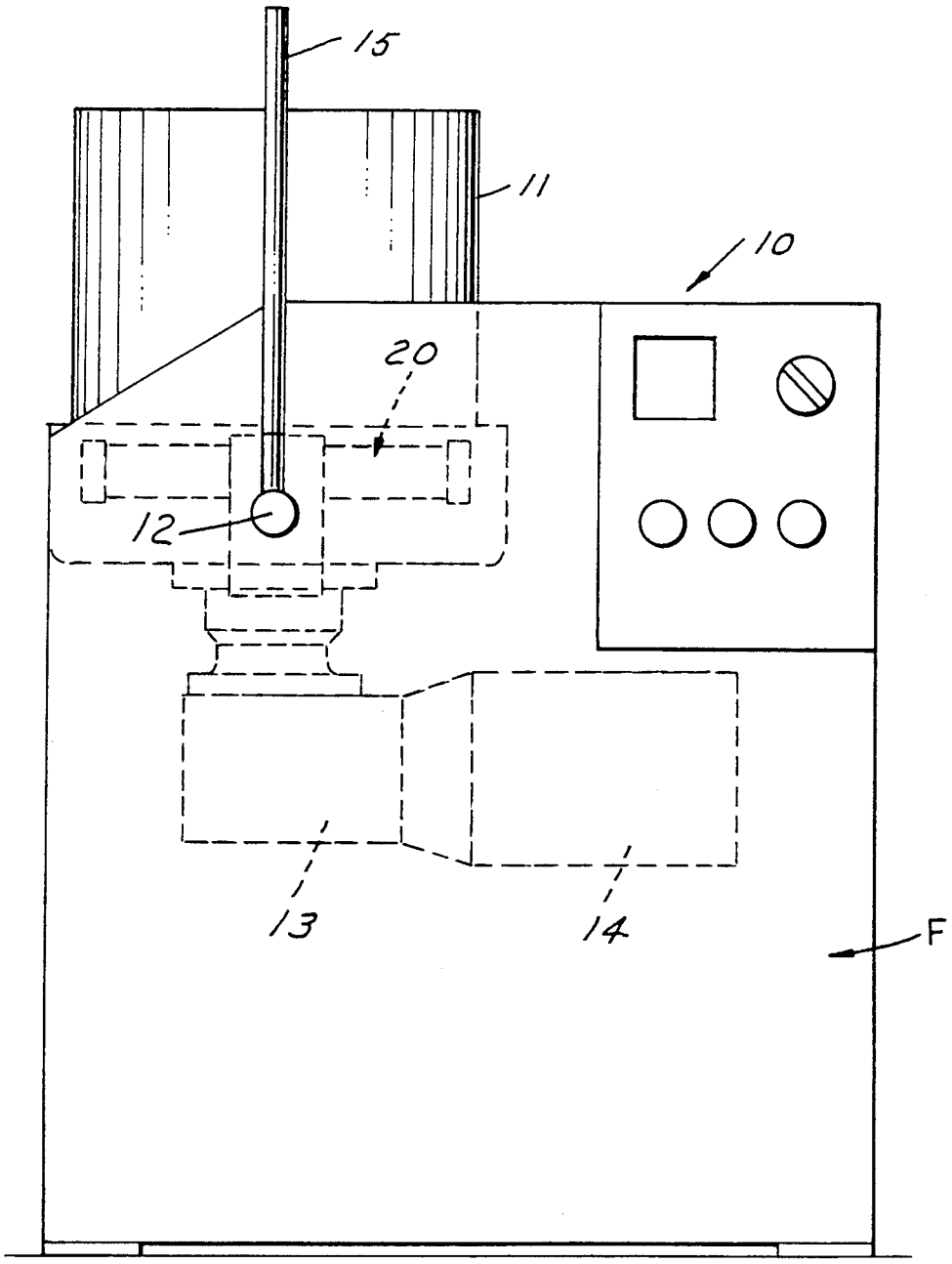
FIG. 1 is a partly diagrammatic view of a centrifugal finishing machine embodying the invention.

Referring to FIG. 1, a centrifugal finishing machine to which the invention relates comprises tub 11 which is mounted on a frame F while pivoting about a horizontal axis by stub shafts 12. The finishing machine normally operates with the tub in upright position to finish work pieces and then is tilted by grasping a handle 15 to pivot the tub and dispense the contents.

In accordance with the invention, a hydro-mechanical system 20 is provided which functions by the use of hydraulic fluid to permit hydraulic fluid to flow freely during the tilting movement from the upright to a tilted position and to resist the movement of the tub from the tilting position to the upright position.

Figure 2:
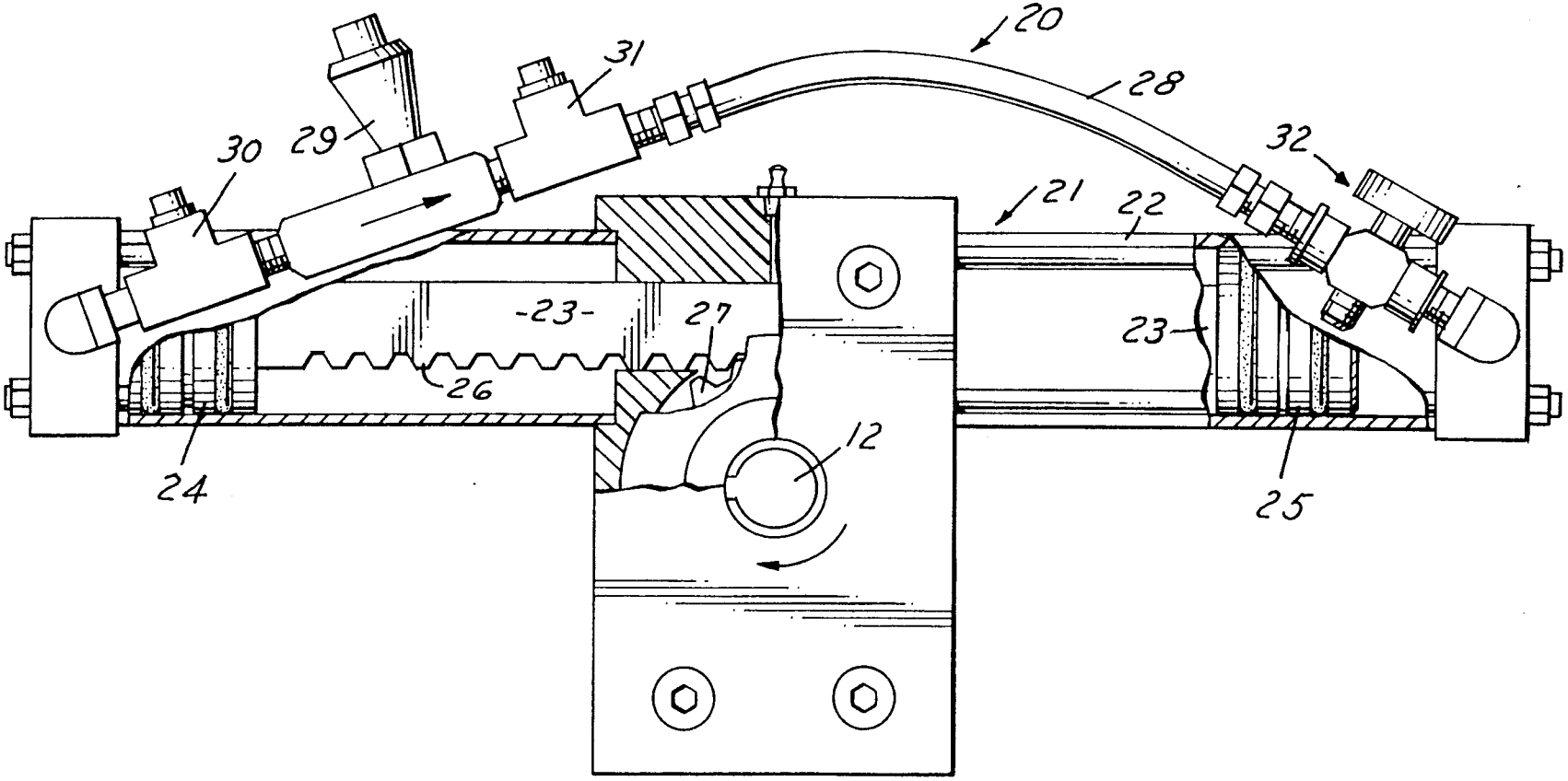
FIG. 2 is a part sectional view of a portion of the machine shown in FIG. 1.

Referring to FIG. 2, in a preferred embodiment, the system comprises a linear actuator 21 comprising a cylinder 22, a piston rod 23, and pistons 24, 25 on the end of the piston rod. The piston rod 23 is formed with a rack 26 so that the gear teeth of the rack can mesh with a pinion 27 mounted for rotation with the tub 11. In the upright position the piston 24 abuts one end of the cylinder 22. The pinion 27 is also connected to the shaft 12 and to the handle 15. When the handle 15 is tilted, the pinion 27 will move the piston rod 23 and associated pistons 24, 25 to the right as viewed in FIG. 2.

A hydraulic line 28 connects the cylinder formed by piston 24 at one end with the cylinder formed by piston 25 at the opposite end. Within this line, a flow control valve 29 and capped openings 30, 31 are provided for fully filling the lines and actuator. The end of the cavities in the line are filled with hydraulic fluid through removable caps.

When the machine is in the upright position, piston 24 is firmly resting against the end of the cylinder at one end of the actuator. The machine tub 11 cannot move due to this positive stop.

As the machine tub 11 is tilted forward, the one-way flow control valve 29 permits fluid to flow freely while resistance of the flow control limits the speed at which the tub 11 will return to an upright position.

A manual butterfly or rotary valve 32 allows the operator to "lock" the machine tub 11 at any position within the limits of rotation. This is primarily for use when the unloading the contents of the tub 11, to allow the use of both hands freely. When the machine is operating, manual tilting of the tub 11 forward, for example, ten to twenty degrees, and closing the butterfly valve 32, allows for parts inspection to be done easily since the mass of parts and media slows when the tub is tilted partially. In addition, the finishing of some parts may be facilitated by operating in a position other than completely "upright".

Figure 3:
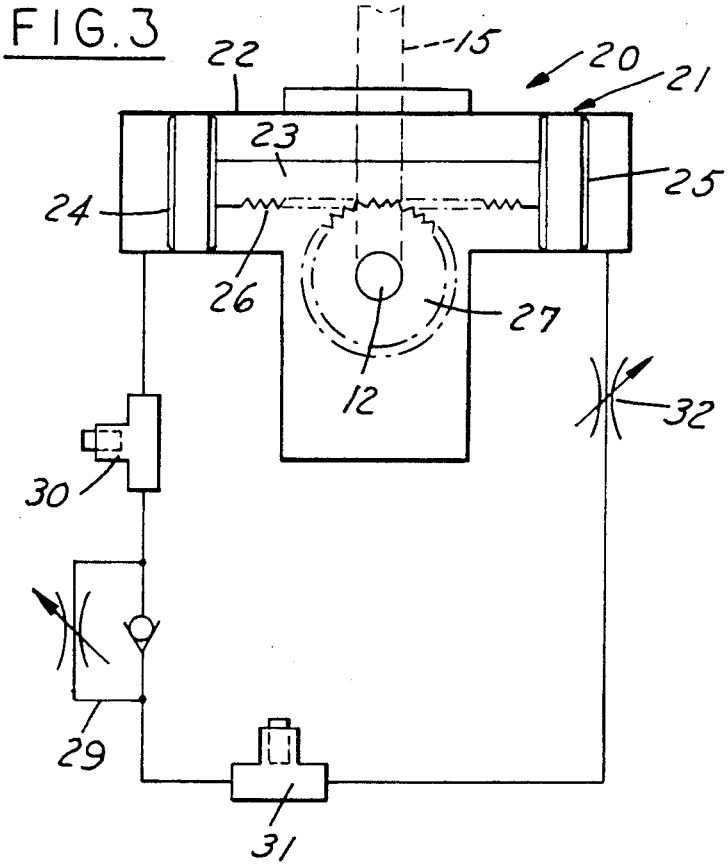
FIG. 3 is a hydraulic schematic of the system shown in FIG. 2.

FIG. 3 is a schematic of the system shown in FIG. 2.

Figure 4:
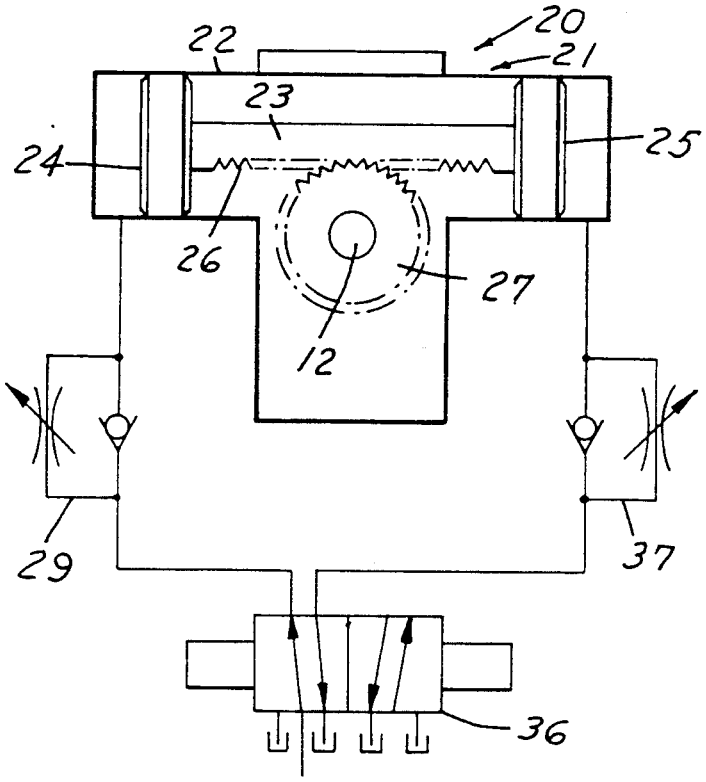
FIG. 4 is a hydraulic schematic of a modified form system.

It is also possible to "power" the tilting of the tub by adding a manual valve or automating by using a solenoid valve 36 as shown schematically in FIG. 4. A flow control 37 is also added to the cylinder formed by piston 25 to control the speed of tilting the tub from the upright position forward. The butterfly valve can still be utilized to hold the tub at any position about the rotation for the same reasons as above. Power can be defined as air, water, oil or air over oil.

The following features are included by the tilting system:

(a) Rotary actuator used to control tilting of a finishing machine.

(b) Hydraulic action used to control return of finishing tub to an upright position.

(c) Use of flow control to control speed of machine tub return to an upright position.

(d) Unique use of hydraulic fluid passing from one cylinder to the other within a closed-loop and utilizing a flow control to control speed on a self-contained unit.

(e) Use of butterfly valve to "hold" machine tub in a specific position, such as that for unloading.

(f) The ability to "power" or automate the above.

(g) The ability to hold position within a "power" or automatic mode. It can thus be seen that there has been provided a system for tilting centrifugal finishing machines which obviates the problems with the prior art.

I claim:

1. A tilting system for a centrifugal finishing machine which include a finishing chamber or tub which is in upright position and is rotated about a vertical axis treatment of parts or work pieces and which is pivoted about a horizontal axis for tilting to a tilted position to remove the parts, said machine having drive means thereon the weight of which tends to return the tub to upright position, and means for moving the tub from upright to tilted position, said tilting system comprising a hydro-mechanical system which functions to permit free movement from an upright position to a tilted position under the action of said means for moving the tub from upright to tilted position and to retard movement from a tilted position to an upright position against the action of the weight of the drive means, said hydro-mechanical system comprises a hydraulic actuator connected to the tub, a line extending from one end of the actuator to the other and a one way flow control valve in the line oriented to retard the flow of hydraulic fluid when the tub is moved from a tilted position to an upright position.

2. The tilting system for a centrifugal finishing machine set forth in claim 1 wherein said hydraulic actuator comprises a hydraulic linear actuator which has a piston rod with pistons at each end and connected by a rack and pinion arrangement to the tub.

3. The tilting system for centrifugal finishing machines set forth in any one of claims 1 or 2 including lock means in said line for preventing flow in said line in a direction that the fluid would flow in said line when the tub would be moved from a tilted position toward the upright position by the weight of the drive means to lock the tub in any desired tilted position.

4. The tilting system for centrifugal finishing machines set forth in claim 3 wherein said lock means is manually operated.

5. The tilting system for centrifugal finishing machines set forth in claim 3 wherein said lock means is power operated.

* * * * *